US010161280B2

(12) United States Patent
Hirth et al.

(10) Patent No.: US 10,161,280 B2
(45) Date of Patent: Dec. 25, 2018

(54) METHOD FOR INFLUENCING A FLUID FLOW

(71) Applicant: Continental Automotive GmbH, Hannover (DE)

(72) Inventors: Peter Hirth, Roesrath (DE); Thomas Haerig, Neunkirchen-Seelscheid (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/305,855

(22) PCT Filed: Apr. 23, 2015

(86) PCT No.: PCT/EP2015/058782
§ 371 (c)(1),
(2) Date: Oct. 21, 2016

(87) PCT Pub. No.: WO2015/162202
PCT Pub. Date: Oct. 29, 2015

(65) Prior Publication Data

US 2017/0044954 A1 Feb. 16, 2017

(30) Foreign Application Priority Data

Apr. 24, 2014 (DE) ..... 10 2014 105 770

(51) Int. Cl.
*F01N 3/28* (2006.01)

(52) U.S. Cl.
CPC ..... *F01N 3/2803* (2013.01); *F01N 3/281* (2013.01); *F01N 3/2828* (2013.01);
(Continued)

(58) Field of Classification Search
CPC .... F01N 3/2803; F01N 3/281; F01N 2330/02; F01N 2260/14
See application file for complete search history.

(56) References Cited

U.S. PATENT DOCUMENTS 5,403,559 A 4/1995 Swars
6,190,784 B1 2/2001 Maus et al.
(Continued)

FOREIGN PATENT DOCUMENTS

DE 8908738 U1 10/1989
DE 4025434 A1 2/1992
(Continued)

OTHER PUBLICATIONS

Machine translation of JP 2007-218142 A, accessed on Jun. 14, 2018.*
(Continued)

*Primary Examiner* — Jonathan Matthias

(57) ABSTRACT

A method for influencing a fluid flow in a fluid line is provided. The fluid line has a wall and a honeycomb body arranged in the fluid line with a fluid inlet side and a fluid outlet side. The honeycomb body has a honeycomb structure with a cross section area and with ducts through which the fluid flow can flow from the fluid inlet side to the fluid outlet side. The honeycomb body has an outer boundary. The honeycomb structure has a circumferential outer zone close to the boundary and a central zone arranged within the outer zone. The outer zone includes at most 70% of the cross section area. The method includes providing the fluid flow upstream of the honeycomb body, entry of the fluid flow into the honeycomb body, and at least partial redirection of the fluid flow outwards in a radial direction.

12 Claims, 3 Drawing Sheets

(52) U.S. Cl.
CPC ..... *F01N 2260/14* (2013.01); *F01N 2330/02* (2013.01); *F01N 2330/06* (2013.01); *F01N 2330/30* (2013.01)

(56) References Cited

U.S. PATENT DOCUMENTS

| | | | | |
|---|---|---|---|---|
| 2002/0044896 | A1 | 4/2002 | Maus et al. | |
| 2005/0054526 | A1 | 3/2005 | Steinke et al. | |
| 2005/0214178 | A1* | 9/2005 | LaBarge ..... | B01D 53/9454 422/180 |
| 2008/0110341 | A1 | 5/2008 | Ketcham et al. | |
| 2008/0159931 | A1 | 7/2008 | Feinstein | |

FOREIGN PATENT DOCUMENTS

| | | | |
|---|---|---|---|
| DE | 29723721 | U1 | 1/1999 |
| DE | 19938038 | A1 | 5/2000 |
| DE | 19908834 | A1 | 9/2000 |
| GB | 2342055 | A | 4/2000 |
| JP | H07279652 | A | 10/1995 |
| JP | 2003148127 | A | 5/2003 |
| JP | 2007218142 | A | 8/2007 |

OTHER PUBLICATIONS

International Search Report dated Jul. 27, 2015 from corresponding International Patent Application No. PCT/EP2015/058782.
German Search Report dated Dec. 22, 2014 from corresponding German patent application No. 10 2014 105 770.8.
English Abstract for DE 4025434 A1.
English Abstract of JP H07279652 A.

* cited by examiner

Fig. 1
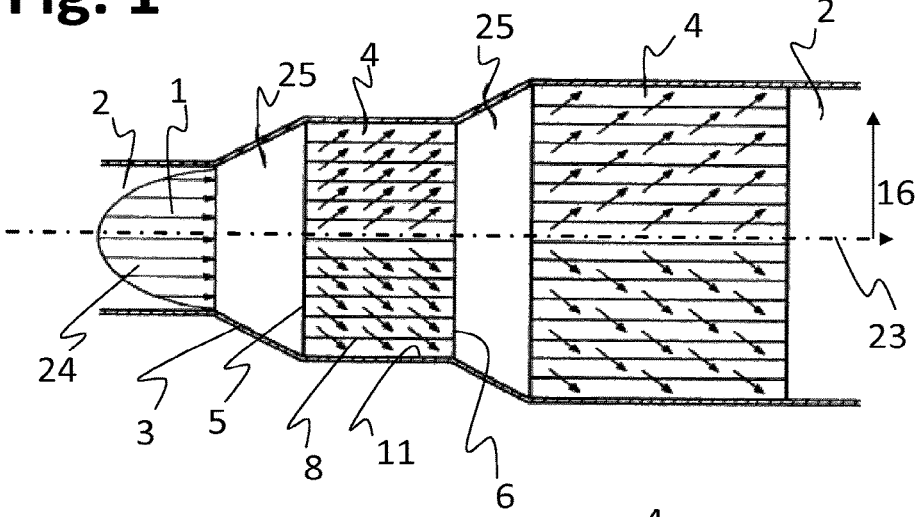
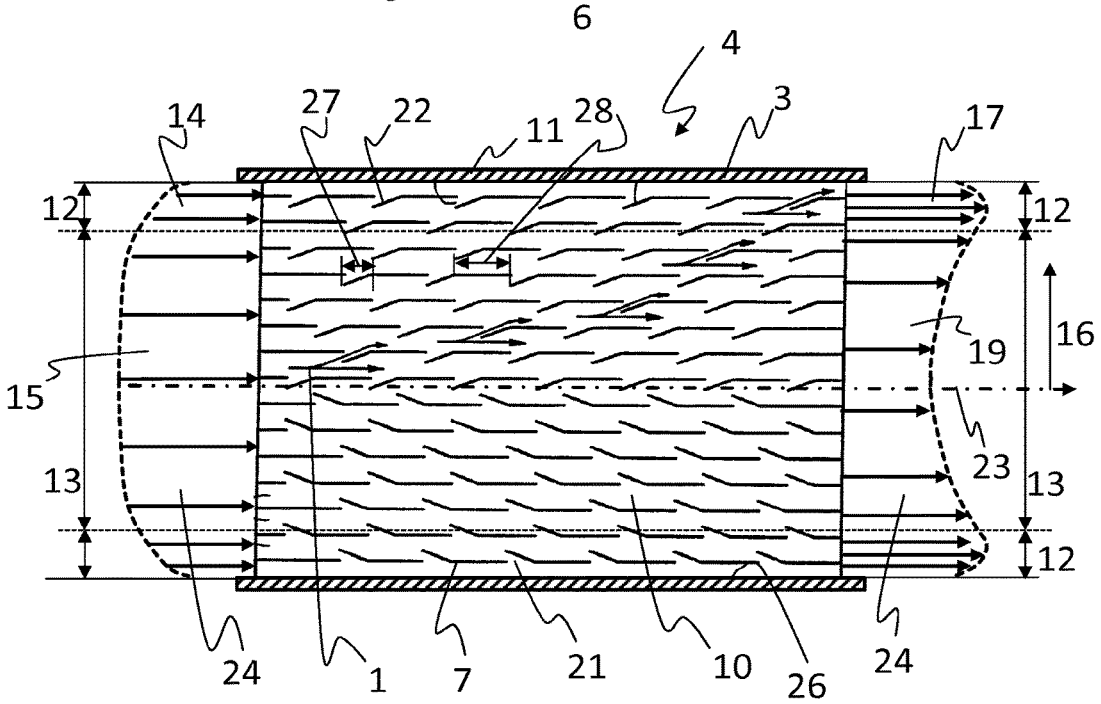
Fig. 2

METHOD FOR INFLUENCING A FLUID FLOW

TECHNICAL FIELD

The disclosure relates to a method for influencing a fluid flow, which may be used in the treatment of an exhaust had of an internal combustion engine

BACKGROUND

Processes such as the treatment of an exhaust gas of an internal combustion engine, chemical processes in the context of a Fischer-Tropsch synthesis (carbon monoxide reacts with hydrogen to form hydrocarbon compounds), methanation (carbon dioxide or carbon monoxide reacts with hydrogen to form methane), a Sabatier process (carbon dioxide and hydrogen react to form methane), any exothermic, heterogeneously catalyzed gas phase reaction (that is to say for any exothermic conversion of gases on, for example, solid or liquid catalysts) use a gas mixture that passes across a catalyst. Inter alia, it has been the case until now that pellet catalysts have been used in these processes. The use of pellet catalysts ensures (albeit only to a small extent) a dissipation of the heat that arises during the exothermic reactions. The form of catalysts however entails high installation costs, wherein at the same time, the throughput through the catalytic converter is limited because, for adequate dissipation of heat, it has only been possible to use pipes with small diameters (for pellet catalysts with small cross-sectional area).

SUMMARY

The disclosure relates to a method for influencing a fluid flow. The method may be used in the treatment of an exhaust gas of an internal combustion engine. The method may also be used for chemical processes in the context of a Fischer-Tropsch synthesis (carbon monoxide reacts with hydrogen to form hydrocarbon compounds), in methanation (carbon dioxide or carbon monoxide reacts with hydrogen to form methane), and in the context of a Sabatier process (carbon dioxide and hydrogen react to form methane). The method may also be suitable for any exothermic, heterogeneously catalyzed gas phase reaction (that is to say for any exothermic conversion of gases on, for example, solid or liquid catalysts).

It is desirable to solve or at least alleviate the technical problems highlighted in conjunction with the prior art. As such, it is desirable to propose a particularly advantageous method for influencing a fluid flow that is firstly inexpensive and/or secondly permits higher throughputs and/or advantageously influences the thermal management in the above-mentioned processes.

The method as per the features described below, which may be specified individually in the claims and may be combined with one another in any desired technologically meaningful manner and may be supplemented by explanatory facts from the description, with further design variants of the invention being highlighted.

One aspect of the disclosure provides a method for influencing a fluid flow, where the fluid flow is situated in a fluid line with a wall. A honeycomb body with a fluid inlet side and a fluid outlet side is arranged in the fluid line. In some examples, the honeycomb body has at least one at least partially structured metallic layer that at least partially forms a honeycomb structure with a cross-sectional area and with ducts through which the fluid flow can pass from the fluid inlet side to the fluid outlet side. The honeycomb body has an outer boundary, for examples in the form of a shell or an outer wall. The honeycomb structure has an encircling outer zone close to the boundary and has a central zone arranged within the outer zone. In some examples, the outer zone accounts for at most 70%, for example, at most 40%, at most 20%, of the cross-sectional area. In some implementations, the method includes at least the following steps: a) providing the fluid flow upstream of the honeycomb body; and b) introducing the fluid flow into the honeycomb body via the fluid inlet side. At the fluid inlet side, the average first inflow speed of the fluid flow in the outer zone close to the boundary is lower than the average second inflow speed of the fluid flow in the central zone. The method also includes c) at least partially diverting the fluid flow in an outward radial direction, such that, at the fluid outlet side, the average first outflow speed of the fluid flow in at least one subregion of the outer zone close to the boundary is at least 20%, in some examples, at least 40%, higher than the average second outflow speed of the fluid flow in the central zone.

In some examples, the method is aimed at diverting a conventional pipe flow (with a relatively slow fluid flow in the region close to the wall) such that, downstream of the honeycomb body, the fluid flow flows faster in the region close to the wall than in the central region of the fluid line. The diversion of the fluid flow also has the effect that the heat of the fluid flow may be extracted largely via the wall of the fluid line.

In some implementation, the method or the honeycomb body are adapted such that an inverse effect is realized, that is to say a focused diversion inward with a corresponding increase of the outflow speed in the central zone.

Thus, the method may be used in particular for the processes mentioned in the introduction. Consequently, the method proposed here for influencing a fluid flow is in particular a method in conjunction with a Fischer-Tropsch synthesis, a methanation, or a Sabatier process.

Implementations of the disclosure may include one or more of the following optional features. In some implementations, in the method, use be made of a honeycomb body (or if appropriate also a multiplicity of honeycomb bodies) by way of which the fluid flow is diverted with greater intensity in the direction of an outer wall. The honeycomb body may be manufactured using the materials that can withstand the above processes, for example, from metal or ceramic (possibly also by way of a rapid-prototyping method or by way of a layer printing method).

The method is thus not aimed at a homogenization of the flow speeds. On the contrary, it is specifically sought here to realize an uneven distribution of the flow speed, where it is the intention for higher flow speeds to prevail in the region close to the wall than in a central zone.

The expression "average" (first and second in-/out-) flow speed is to be understood here in each case to mean the averaged flow speed of the fluid flow in the outer zone and the central zone. For distinction or definition of the outer zone and of the central zone, consideration may, for illustrative purposes, be given to geometrical sizes, such as for example a bisection of the diameter of the honeycomb body. It is likewise possible to select, as a boundary, approximately that region in which a significant drop of the flow speed of the fluid flow close to the wall can be identified. If the honeycomb body has a singular irregularity (for example a central crimped zone and/or a winding hole), the central zone should extend at least over twice the diameter of the irregularity.

In some examples, the honeycomb body is of cylindrical form. However, cuboidal, polygonal, conical, or other forms are also possible.

In some implementations, the honeycomb structure is formed by at least one structured metallic layer which, at the face surfaces of the honeycomb body (fluid inlet side and fluid outlet side), forms in each case one cross-sectional area with ducts that can be traversed by the fluid flow from the fluid inlet side to the fluid outlet side.

The honeycomb structure may also be formed by ceramic materials that are commonly provided for the production of honeycomb bodies, for example, for the treatment of exhaust gas of internal combustion engines. However, the example with at least one metallic layer is advantageous because the particularly advantageous examples (spiral winding, guide surfaces for effective diversion, openings) may be produced more inexpensively while realizing the same performance.

The at least one structured metallic layer may be produced from a corrosion-resistant, heat-resistant alloy (for example a steel alloy with components of chromium, nickel and aluminum; for example material numbers 1.4767, 1.4725 according to the standard EN 10027-2:1992-09), and may have a thickness of 10 μm [micrometers] to 100 μm. In some examples, all steels that are commonly used in the chemical engineering industry may be used. The honeycomb structure has, in particular, a cell density from 10 to 1000 cpsi (cells per square inch). In particular, the honeycomb structure may extend as far as the outer boundary of the honeycomb body. The outer boundary forms a housing of the honeycomb body and is connected to the fluid line or forms the wall of the fluid line (at least in the region of the honeycomb body).

In some implementations, the at least one metallic layer is wound in spiral-shaped form. For example, the honeycomb structure is constructed from precisely one single smooth and one single structured metallic layer, which, laid one on top of the other and wound in spiral-shaped form, extend from the inside radially outward. In particular, in this way, a situation is prevented in which metallic layers are folded and then wound in spiral-shaped form. In particular, it is thus the case that the single smooth layer and the single structured layer form the entire honeycomb structure.

In tests, it has been found that specifically one spiral-shaped winding of the at least one metallic layer yields a more effective diversion of the fluid flow if the number and/or design of flow-guiding surfaces and openings are suitably configured. With the functional design specification given here, this does not constitute a problem for a person skilled in the art, and can also be easily checked by way of a (continuous and classic) pipe flow. The fluid flow is transported uniformly in a radially outward direction, such that, in particular, the encircling inner surface of the fluid line downstream of the honeycomb body is impinged on uniformly by the fluid flow.

In some examples, the fluid flow, as it flows through the honeycomb body, is at least partially catalytically converted by way of a catalytic coating of the honeycomb body. An exothermic reaction takes place here, such that the average temperature of the fluid flow downstream of the honeycomb body is greatly increased in relation to the average temperature of the fluid flow upstream of the honeycomb body (a difference of greater than 100 K [Kelvin]). For example, the average temperature of the fluid flow increases by 30 K per 100 mm [millimeters] length of the honeycomb body (along the axis).

In some examples, the catalytic coating includes a wash code, such that the effective surface area of the honeycomb structure for contact with the fluid flow is further enlarged. The catalytic coating may include (exclusively) oxidizing catalysts, which catalyze highly exothermic reactions.

The method is duly particularly suitable for, but not restricted to, the processes mentioned in the introduction. For example, the method may also be used in the context of a heat exchanger process. Here, it is for example possible for a fluid flow within the honeycomb body to be catalytically converted, where the fluid flow is heated as a result of the exothermic reaction. The heat is transported through the honeycomb body to the wall of the fluid line and can, from there, be used for heating a medium or the surroundings outside the fluid line.

The honeycomb body may be formed substantially from alternating smooth and structured metallic layers, where the smooth metallic layers have at least openings, and the structured metallic layers have at least flow-guiding surfaces. In some examples, it is possible for both smooth and structured layers to have openings and flow-guiding surfaces.

In some implementations, all of the flow-guiding surfaces in the honeycomb body are oriented similarly, that is to say the fluid flow is always transferred in the same way at least partially out of one duct into an adjacent duct.

In some examples, it is always the case that the fluid flow flows from one duct into an adjacent duct through openings in a smooth layer. The openings may be circular. The openings may have a radius which amounts to at least 50%, in particular at least 100% and very particular preferably at least 170% of the cross-section a width of the duct of the honeycomb body. In absolute terms, it is preferable for the opening to have a radius in the range from 5 to 13 mm [millimeters], in particular in the range from 7 to 10 mm.

In some implementations, the structured metallic layers have flow-guiding surfaces that all divert the fluid flow in a common direction (for example radially outward or into a duct situated radially further to the outside). In each duct, at least four, preferably at least eight, or even at least eleven flow-guiding surfaces may be arranged one behind the other per 150 mm length of the duct of the honeycomb body (along the axis). In some examples, the distance between two flow-guiding surfaces within a duct (along the axis from the end of one flow-guiding surface to the start of the next flow-guiding service) amounts to at least 10 mm [millimeters], preferably at least 12 mm. The length of a flow-guiding surface (along the axis from the start to the end of an individual flow-guiding surface) amounts to at least 3 mm, in particular at least 7 mm. In some examples, flow-guiding surfaces are arranged in all of the ducts. For example, a flow-guiding surface extends into a duct to such an extent that at least 60% of the duct cross-sectional area is covered by the flow-guiding surface. The flow-guiding surface thus extends from the duct wall into the interior of the duct, such that the fluid flow in the duct strikes the flow-guiding surface and is diverted. In some examples, at each flow-guiding surface, at least 25%, preferably at least 40%, of the fluid flow is led out of a duct. It is preferably also the case that the number of flow-guiding surfaces per duct is approximately constant (for example at most +/−2), and/or the form of all flow-guiding surfaces is the same.

The abovementioned parameter for the arrangement of the flow-guiding surfaces is particularly advantageous. Maximum diversion of the fluid flow is achieved, and in particular, the pressure loss in the flow through the honeycomb body is kept low.

In particular, at the fluid inlet side, the average second inflow speed of the fluid flow in the central zone is greater by a factor of 2 to 3 than the average first inflow speed of the fluid flow in the outer zone close to the boundary.

In some implementations, at the fluid outlet side, the average first outlet speed of the fluid flow in at least one subregion of the outer zone close to the boundary, or in the entire outer zone close to the boundary, is at least 20%, in particular at least 40%, preferably 100% to 400% higher than the average second outflow speed of the fluid flow in the central zone. In some examples, at the fluid outlet side, the average first outflow speed of the fluid flow in at least one subregion of the outer zone close to the boundary, or in the entire outer zone close to the boundary, is 200% to 400%, in particular 300% to 400%, higher than the average second outflow speed of the fluid flow in the central zone.

Another aspect of the disclosure provides a honeycomb body for use in the method, where the honeycomb body has a fluid inlet side and a fluid outlet side and an outer boundary. The honeycomb body has ducts that can be traversed by a fluid flow from the fluid inlet side to the fluid outlet side. The ducts (that is to say the duct walls that form the ducts) at least partially have openings and flow-guiding surfaces for diverting the fluid flow in an outward radial direction, and at least partially have a catalytic coating.

In some examples, the honeycomb body has at least one at least partially structured metallic layer that forms the ducts. In some implementations, the at least one metallic layer at least partially has openings and flow-guiding surfaces for diverting the fluid flow in an outward radial direction, and at least partially has a catalytic coating.

The statements made regarding the method according to the disclosure likewise apply to the honeycomb body, and vice versa.

According to the disclosure, it is proposed that a fluid flow be diverted radially outward such that, firstly, as large as possible a catalytically active surface area is flowed over by a major part of the fluid flow, and secondly, a large amount of the heat generated as a result of the catalytic reaction is dissipated to the outside via the fluid line downstream of the honeycomb body. These aims can be influenced by way of the adapted configuration of the honeycomb body. A more intense diversion within the honeycomb body firstly increases the average first outflow speed in the zone close to the boundary, where the catalytically active surface passed over by the fluid flow is thereby reduced (the surface area of the central zone in the downstream part of the honeycomb body is flowed over only by small components of the fluid flow).

The details of one or more implementations of the disclosure are set forth in the accompanying drawings and the description below. Other aspects, features, and advantages will be apparent from the description and drawings, and from the claims.

DESCRIPTION OF DRAWINGS

The disclosure and the technical field will be discussed in more detail below on the basis of the figures. It is noted that the figures, and in particular the proportions illustrated in the figures, are merely schematic.

FIG. 1 is a side view of an exemplary honeycomb body in a fluid line;

FIG. 2 is a side view of an exemplary honeycomb body;

Like reference symbols in the various drawings indicate like elements.

DETAILED DESCRIPTION

Figure 3:
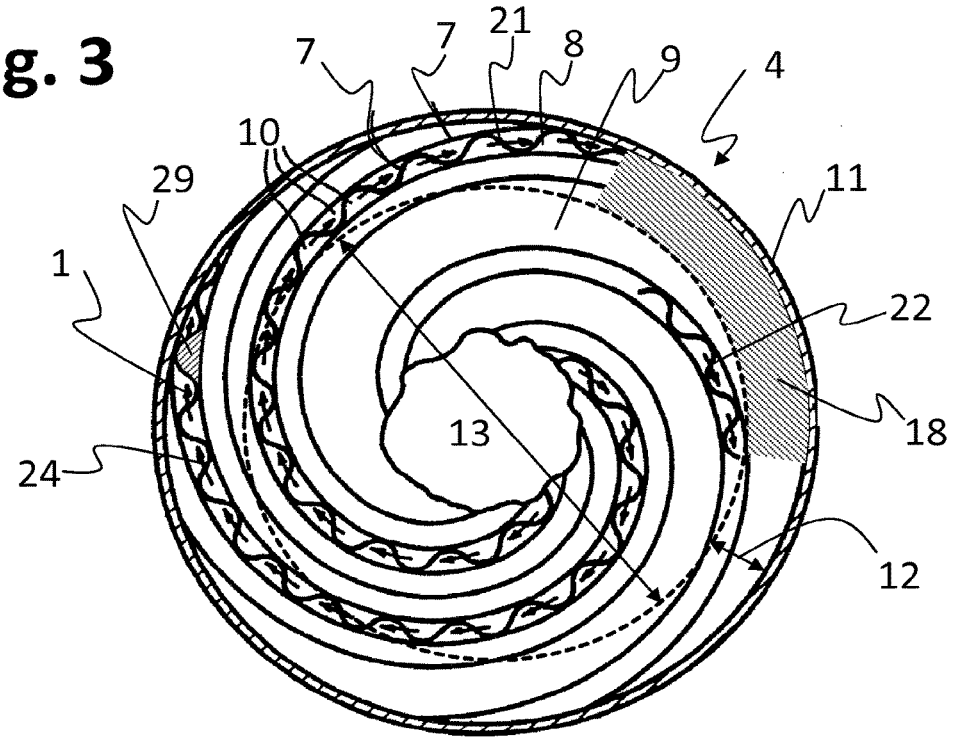
FIG. 3 is a cross-sectional view of an exemplary honeycomb body.

FIG. 1 shows multiple honeycomb bodies 4, which, in a flow direction, are arranged one behind the other along an axis 23 in a fluid line 2. The fluid line 2 has a wall 3 that directly surrounds the individual honeycomb bodies 4. A fluid flow 1 passes along the axis 23 through the fluid line 2 to the honeycomb body 4. In FIG. 1, flow speeds 24 of the fluid flow 1 in the fluid line 2 are illustrated. It can be seen that the flow speeds 24 near the wall are lower than those in the center of the fluid line 2. This is approximately the conventional profile of flow speeds 24 in a fluid line 2 (pipe flow). The fluid flow 1 enters the first honeycomb body 4 via a fluid inlet side 5. The honeycomb structure 8 of the honeycomb body 4 is constructed such that the fluid flow 1 is in each case diverted outward in a radial direction 16 proceeding from the axis 23. The fluid flow 1 emerges again from the fluid outlet side 6 of the honeycomb body 4, where the profile of the flow speeds 24 has now changed (see the statements relating to FIG. 2). The flow through the second honeycomb body 4 behaves in the same way. In this case, merely by way of example, the fluid line 2 is formed with conical sections 25. Honeycomb bodies 4 may also be arranged in such conical sections 25, and then correspondingly have conical honeycomb structures 8.

FIG. 2 shows a honeycomb body 4 in a side view in section, where the profiles of the flow speeds 24 are shown here in detail. In some implementations, the honeycomb body 4 has an outer boundary 11, which may also constitute the wall 3 of the fluid line 2. In some examples, the outer boundary 11 is a housing to which the honeycomb structure 8 is connected, such that a honeycomb body 4 is formed. The honeycomb body 4 may be used in fluid lines 2. The fluid flow 1 has, at the fluid inlet side 5 of the honeycomb body 4, a profile of the flow speeds 24 that corresponds to the profile of a pipe flow. A relatively low average first inflow speed 14 prevails in an encircling outer zone 12 close to the boundary, and a relatively high average second inflow speed 15 prevails in a central zone 13 surrounded by the outer zone 12.

Here, the expression "average" (first and second in-) flow speed 14, 15 refers in each case to the averaged flow speed 24 of the fluid flow 1 in the outer zone 12 and the central zone 13. It is pointed out that a dynamic pressure may already prevail directly upstream of the honeycomb body 4, such that the flow speeds 24 may deviate slightly from the profile shown.

The honeycomb structure 8 of the honeycomb body 4 is formed by layers 7 that form ducts 10 through which the fluid flow 1 can pass. The layers 7 have openings 21 and flow-guiding surfaces 22. The flow-guiding surfaces 22 and openings 21 effect a diversion of the fluid flow 1 within the honeycomb structure 8 in an outward radial direction 16, proceeding from the central axis 23, toward the outer boundary 11. The fluid flow 1 is thus transferred from one duct 10 into respectively adjacent ducts 10 via openings 21 and by way of flow-guiding surfaces 22. Owing to the diversion, the fluid flow 1 at the fluid outlet side 6 of the honeycomb body 4 has a changed profile of the flow speeds 24. In some examples, the average first outflow speed 17 in the outer zone 12 close to the boundary is at least 20% higher than the average second outflow speed 19 of the fluid flow 1 in the central zone 13. The flow-guiding surfaces 22 each have a length 27 (measured parallel to the axis 23) and are arranged to be spaced apart from one another by a distance 28 (along the axis 23).

The fluid flow 1 is thus diverted by the honeycomb body 4 toward the outer boundary 11 or toward the wall 3 of the fluid line 2. In some implementations, the diversion leads to more intensive contact between the fluid flow 1 and inner surface 26 of the wall 3, such that heat from the fluid flow 1 can be released to the wall 3, and dissipated via the wall 3, to an increased extent.

FIG. 3 illustrates a cross-section view of a honeycomb body 4. The honeycomb body 4 has an outer boundary 11 and, within the outer boundary 11, a honeycomb structure 8 that is formed by smooth and structured (in this case undulating) metallic layers 7. In some examples, the metallic layers 7 have been wound in spiral-shaped form. The honeycomb structure 8 has ducts 10 with duct cross-sectional areas 29. The layers 7 have openings 21 and flow-guiding surfaces 22, by way of which the fluid flow 1 is transferred from one duct 10 into respectively adjacent ducts 10 (see arrows of the flow speeds 24). In some examples, the outer zone 12 directly adjacent to the outer boundary 11 accounts for at most 20% of the total cross-sectional area 9 of the honeycomb structure 8. The diversion of the fluid flow 1 within the honeycomb structure 8 may also be realized in that an increased average first outflow speed 17 prevails only at least in one subregion 18 of the outer zone 12 close to the boundary, which increased average first outflow speed is at least 20% faster than the average second outflow speed 19 in the central zone 13.

Figure 4:
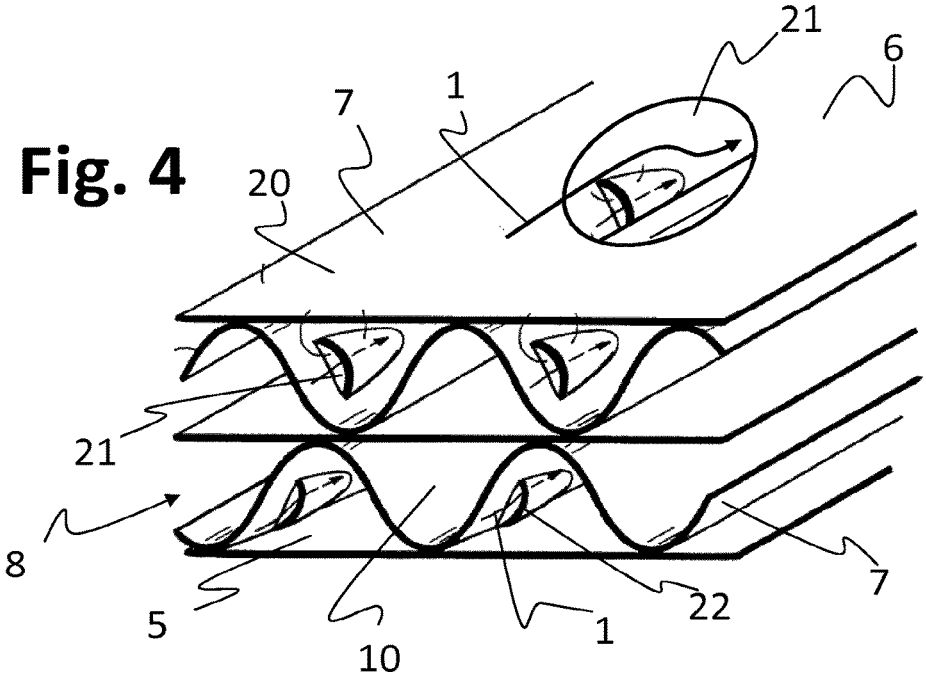
FIG. 4 is a perspective view of multiple layers of an exemplary honeycomb structure.

FIG. 4 shows multiple layers 7 of a honeycomb structure 8 in a perspective view. Smooth and structured layers 7 are arranged one on top of the other, such that ducts 10 are formed through which the fluid flow 1 passes from a fluid inlet side 5 to a fluid outlet side 6. In some implementations, the layers 7 have a coating 20. As shown, the structured layer 7 has openings 21 and flow-guiding surfaces 22, such that the fluid flow 1 is transferred from one duct 10 into an adjacent duct 10. In some examples, as shown, the smooth layer 7 has only openings 21, which in particular interact with the flow-guiding surfaces 22 of the structured layer 7 such that a more intense diversion of the fluid flow 1 within the honeycomb structure 8 is realized. In some examples, the smooth layer 7 may also have openings 21 and flow-guiding surfaces 22.

Figure 5:
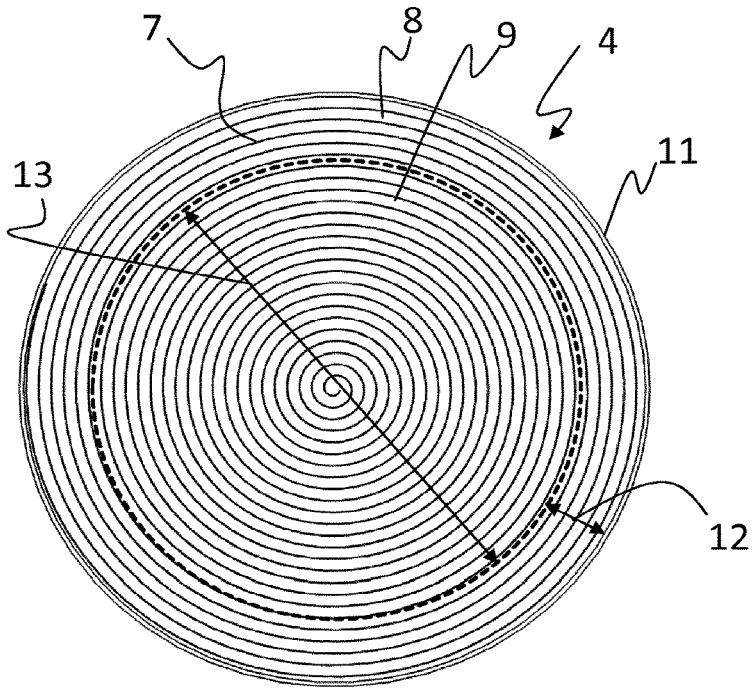
FIG. 5 is a cross-sectional view of an exemplary design of a honeycomb body.

FIG. 5 shows a design variant of a honeycomb body 4 in cross section. As shown, the honeycomb structure 8 is formed by a smooth and a structured (undulating) metallic layer 7 which is arranged so as to be stacked one on top of the other (that is to say two layers 7), extend along the spiral-shaped line from the inside outward to the outer boundary. In particular, the layers 7 are formed as illustrated in FIG. 6.

Figure 6:
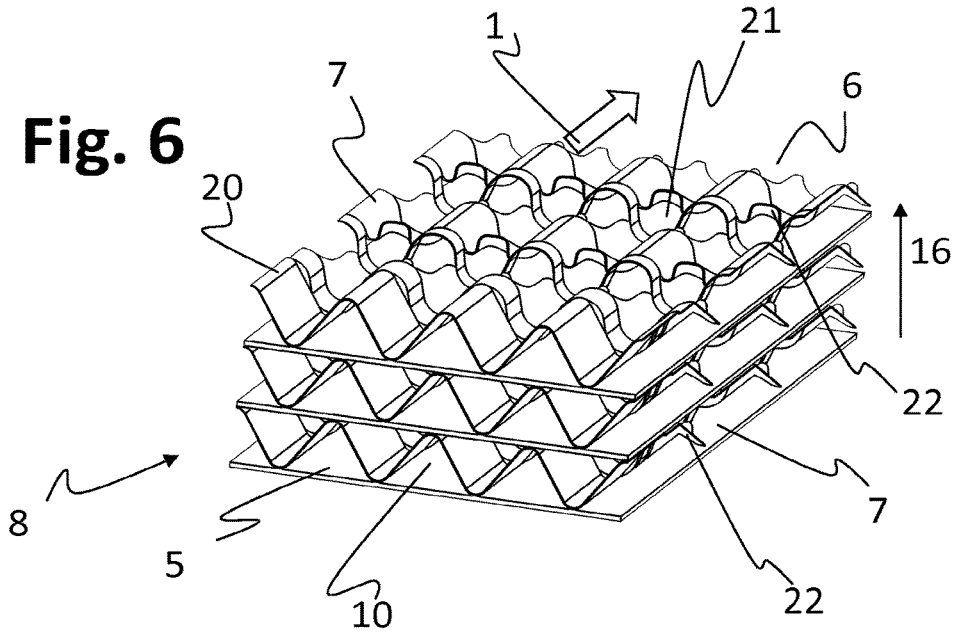
FIG. 6 is a perspective view of an exemplary design of a honeycomb structure0.

FIG. 6 shows a design variant of a honeycomb structure 8 in a perspective view. Smooth and structured layers 7 are arranged one on top of the other, such that ducts 10 are formed through which the fluid flow 1 flows from a fluid inlet side 5 to a fluid outlet side 6. In some examples, the layers 7 have a coating 20. As shown, the structured layer 7 has openings 21 and flow-guiding surfaces 22, such that the fluid flow 1 is transferred from one duct 10 into an adjacent duct 10. Here, the smooth layer 7 has only openings 21 (not visible), which in particular interact with the flow-guiding surfaces 22 of the structured layer 7 such that a more intense diversion of the fluid flow 1 within the honeycomb structure 8 is realized. The structured layer 7 has openings 21 and flow-guiding surfaces 22 (arranged so as to partially interact) such that, in any case, the fluid flow 1 leads transferred in a uniform radial direction 16 via an opening 21 in the smooth layer 7 into a duct 10 of an adjacent structured layer 7.

By way of precaution, it is also pointed out that the combinations of technical features shown in the figures are not generally binding. Accordingly, technical features of one figure may be combined with other technical features from another figure and/or from the general description. The only exception to this is if the combination of features has been explicitly referred to here and/or a person skilled in the art recognizes that the basic functions of the device can no longer be fulfilled otherwise. The same reference designations are used in the figures to denote identical objects.

By way of the described method and the honeycomb body, it is made possible to realize particularly inexpensive and effective flow manipulation. In particular, it is thus possible to realize an effective transfer of heat from the fluid flow 1 to/via the outer boundary 11 and/or via the wall 3. Furthermore, a honeycomb structure makes it possible to provide a large effective surface area for a catalyst. This is all the more applicable if a washcoat is arranged as a coating 20 on the layers 7, which washcoat bears the catalytically active components on the thus further enlarged surface.

The honeycomb body 4 thus permits an effective diversion and thus improves dissipation of heat and an effective catalytic conversion of a fluid flow 1.

A number of implementations have been described. Nevertheless, it will be understood that various modifications may be made without departing from the spirit and scope of the disclosure. Accordingly, other implementations are within the scope of the following claims.

LIST OF REFERENCE DESIGNATIONS

1 Fluid flow
2 Fluid line
3 Wall
4 Honeycomb body
5 Fluid inlet side
6 Fluid outlet side
7 Layer
8 Honeycomb structure
9 Cross-sectional area
10 Duct
11 Outer boundary
12 Outer zone
13 Central zone
14 First inflow speed
15 Second inflow speed
16 Radial direction
17 First outflow speed
18 Subregion
19 Second outflow speed
20 Coating
21 Opening
22 Flow-guiding surface
23 Axis
24 Flow speed
25 Section
26 Inner surface
27 Length
28 Distance
29 Duct cross-sectional area

What is claimed is:

1. A method for influencing a fluid flow in a fluid line, the method comprising:

providing a wall;

providing a fluid flow in a fluid line having the wall;

providing a honeycomb body with a fluid inlet side and a fluid outlet side, the honeycomb body arranged in the fluid line;

a honeycomb structure having a cross-sectional area, the honeycomb structure being part of the honeycomb body;

providing a plurality of ducts through which the fluid flow may pass from the fluid inlet side to the fluid outlet side, the plurality of ducts being part of the honeycomb structure;

providing an outer boundary being part of the honeycomb body;

providing an encircling outer zone close to the outer boundary;

providing a central zone arranged within the outer zone, such that the outer zone accounts for at most 70% of the cross-sectional area of the honeycomb structure;

providing the fluid flow upstream of the honeycomb body;

introducing the fluid flow into the honeycomb body via the fluid inlet side, wherein, at the fluid inlet side, an average first inflow speed of the fluid flow in the outer zone close to the boundary is lower than an average second inflow speed of the fluid flow in the central zone; and at least partially diverting the fluid flow in an outward radial direction, such that, at the fluid outlet side, an average first outflow speed of the fluid flow in at least one subregion of the outer zone close to the boundary is at least 20% higher than an average second outflow speed of the fluid flow in the central zone;

wherein the honeycomb body has at least one at least partially structured metallic layer; and wherein the honeycomb body is formed from alternating smooth and structured metallic layers, wherein the smooth metallic layers have at least openings, and the structured metallic layers have at least flow-guiding surfaces.

2. The method of claim 1, wherein the honeycomb body has at least one at least partially structured metallic layer.

3. The method of claim 1, wherein the at least one at least partially structured metallic layer is wound in spiral-shaped form.

4. The method of claim 2, wherein the honeycomb body is formed from alternating smooth and structured metallic layers, wherein the smooth metallic layers have at least openings, and the structured metallic layers have at least flow-guiding surfaces.

5. The method of claim 1, wherein the fluid flow, as it flows through the honeycomb body, is at least partially catalytically converted by way of a catalytic coating of the honeycomb body.

6. The method of claim 1, wherein, on the fluid outlet side, the average first outflow speed of the fluid flow in the entire outer zone close to the boundary is at least 20% higher than the average second outflow speed of the fluid flow in the central zone.

7. A honeycomb body, comprising:

an outer boundary;

a fluid inlet side;

a fluid outlet side;

a honeycomb structure having a cross-sectional area;

a plurality of ducts being part of the honeycomb structure, the plurality of ducts being traversed by a fluid flow from the fluid inlet side to the fluid outlet side;

a plurality of openings, each of the plurality of openings being part of one of the plurality of ducts;

a plurality of flow-guiding surfaces being part of the plurality of openings;

a catalytic coating disposed on each of the plurality of ducts;

a central zone; and an encircling outer zone close to the outer boundary, the central zone arranged within the outer zone, such that the outer zone accounts for at most 70% of the cross-sectional area of the honeycomb structure;

wherein the openings and flow-guiding surfaces divert the fluid flow in an outward radial direction, and at the fluid outlet side, an average first outflow speed of the fluid flow in at least one subregion of the outer zone close to the boundary is at least 20% higher than an average second outflow speed of the fluid flow in the central zone;

wherein the honeycomb body has at least one at least partially structured metallic layer; and wherein the honeycomb body is formed from alternating smooth and structured metallic layers, wherein the smooth metallic layers have the plurality of openings, and the structured metallic layers have the flow-guiding surfaces.

8. The honeycomb body of claim 7, wherein the honeycomb body has at least one at least partially structured metallic layer.

9. The honeycomb body of claim 5, wherein the at least one at least partially structured metallic layer is wound in spiral-shaped form.

10. The honeycomb body of claim 8, wherein the honeycomb body is formed from alternating smooth and structured metallic layers, wherein the smooth metallic layers have at least openings, and the structured metallic layers have at least flow-guiding surfaces.

11. The honeycomb body of claim 7, wherein the fluid flow, as it flows through the honeycomb body, is at least partially catalytically converted by way of a catalytic coating of the honeycomb body.

12. The honeycomb body of claim 7, wherein, on the fluid outlet side, the average first outflow speed of the fluid flow in the entire outer zone close to the boundary is at least 20% higher than the average second outflow speed of the fluid flow in the central zone.

* * * * *